US010081458B2

(12) United States Patent
Cheng

(10) Patent No.: US 10,081,458 B2
(45) **Date of Patent: *Sep. 25, 2018**

(54) SURFACE BONDING FASTENER

(71) Applicant: Taiwan Paiho Limited, Chang Hwa Hsien (TW)

(72) Inventor: Allen Cheng, Chang Hwa Hsien (TW)

(73) Assignee: TAIWAN PAIHO LIMITED, Chang Hwa Hsien (TW)

( * ) Notice: Subject to any disclaimer, the term of this patent is extended or adjusted under 35 U.S.C. 154(b) by 0 days.

This patent is subject to a terminal disclaimer.

(21) Appl. No.: 15/412,274

(22) Filed: Jan. 23, 2017

(65) Prior Publication Data

US 2018/0072465 A1 Mar. 15, 2018

(30) Foreign Application Priority Data

Sep. 9, 2016 (TW) ..... 105129328 A

(51) Int. Cl.
*B65D 33/16* (2006.01)
*B65D 33/25* (2006.01)
*A44B 18/00* (2006.01)

(52) U.S. Cl.
CPC ..... *B65D 33/2508* (2013.01); *A44B 18/0049* (2013.01); *A44B 18/0061* (2013.01); *A44B 18/0088* (2013.01)

(58) Field of Classification Search
CPC ..... B65D 33/2508; A44B 18/0049; A44B 18/0061; A44B 18/0088
(Continued)

(56) References Cited

U.S. PATENT DOCUMENTS 2,248,038 A * 7/1941 Adams ..... B65D 33/22 156/282
5,088,164 A * 2/1992 Wilson ..... B23Q 16/08 24/584.1

(Continued)

FOREIGN PATENT DOCUMENTS

JP 2006-213368 A 8/2006
JP 2010-076830 A 4/2010
WO 2014/033839 A1 3/2014

OTHER PUBLICATIONS

Korean Office Action of Korean Patent Application No. 10-2017-0018491 dated May 10, 2018.

(Continued)

*Primary Examiner* — Jes F Pascua
(74) *Attorney, Agent, or Firm* — Bacon & Thomas, PLLC

(57) ABSTRACT

A surface bonding fastener for opening and closing an opening of a package comprises a first base sheet having a first surface; a second base sheet having a second surface facing the first surface; first and second blocking sheets secured to the first and second surfaces at first and second fixing ends; and plurality of first and second fastening units on first and second free ends opposite to the first and second fixing ends. The first and second fixing ends are closer to the opening of the package than the first and second free ends that are between the first and second base sheets. The first and second fastening units are arranged at intervals in a longitudinal direction and staggered in a transverse direction perpendicular to the longitudinal direction. The first and second fastening units are configured to be fastened with each other for closing the opening of the package.

3 Claims, 9 Drawing Sheets

(58) Field of Classification Search
USPC ..... 383/63
See application file for complete search history.

(56) References Cited

U.S. PATENT DOCUMENTS

| | | | | | |
|---|---|---|---|---|---|
| 5,685,050 | A * | 11/1997 | Murasaki | A44B 18/0061 | 24/442 |
| 5,755,015 | A * | 5/1998 | Akeno | A44B 18/0049 | 24/442 |
| 5,985,406 | A * | 11/1999 | Takizawa | A44B 18/0061 | 24/306 |
| 6,061,881 | A * | 5/2000 | Takizawa | A44B 18/0061 | 24/446 |
| 7,225,510 | B2 * | 6/2007 | Gallant | A44B 18/0042 | 24/451 |
| 7,340,807 | B2 * | 3/2008 | Dais | B65D 33/2541 | 24/443 |
| 8,225,467 | B2 * | 7/2012 | Gallant | A44B 18/0053 | 24/450 |
| 8,641,278 | B2 * | 2/2014 | Ducauchuis | A44B 18/0053 | 24/403 |
| 9,487,333 | B2 * | 11/2016 | VanLoocke | B65D 33/16 | |
| 2018/0008011 | A1 * | 1/2018 | Cheng | A44B 18/0049 | |

OTHER PUBLICATIONS

Japan Office Action of corresponding Japan Patent Application No. 2017-000503, dated Jan. 30, 2018.
Japan Office Action of corresponding Japan Patent Application No. 2017-000503, dated Jun. 19, 2018.

* cited by examiner

SURFACE BONDING FASTENER

BACKGROUND OF INVENTION

1. Field of Invention

The present invention relates to a surface bonding fastener for opening and closing an opening of package, especially to a surface bonding fastener capable of efficiently preventing, while the package is reversely placed, contents contained in the package from unintentionally opening the opening of the package and then dropping out of the package.

2. Related Prior Art

The well-known surface bonding fastener applied for a package (e.g., a zipper bag) mainly uses plastic concave-convex strips respectively disposed near an opening of the package and extending in a transverse direction to achieve a purpose of repeatedly opening and closing the opening of the package. In this regard, however, while the package is reversely placed in the unintentional case or in the transporting process, contents contained in this package (especially for the contents having certain amounts of weight) will apply pressure to the surface bonding fastener which is used to close the opening of the package. Thus, the opening of the package has a possibility to be opened by such pressure, whereby there exists a risk for the contents contained in this package to be dropped out of the package.

FIGS. 1 and 2 show a surface bonding package applied for a package which has been proposed for solving the above-mentioned problems.

As shown in FIG. 1, such surface bonding package comprises a first base sheet 91 and a second base sheet 92 facing each other (corresponding to two opposite sheets at the opening of the package), a blocking sheet 93 secured to the second base sheet 92, and fastening units 94, 95 respectively disposed on the first base sheet 91 and the blocking sheet 93. The fastening units 94, 95 respectively disposed on the first base sheet 91 and the blocking sheet 93 are near the opening 90 of the package and configured to be fastened to each other for closing the opening 90 of the package.

In this regard, however, using such surface bonding fastener still cannot solve the problem that the contents contained in the package may drop out of the package when the package is reversely placed due to the possibility that the opening of the package may be opened unintentionally. Specifically, although the blocking sheet 93 secured to the second base sheet 92 can disperse parts of pressure applied to the fastening units 94, 95, which is used to close the opening 90 of the package, from the contents contained in the package, yet if the package is reversely placed for a long time or the weights of the contents contained in the package is heavy, it still cannot prevent the contents contained in the package from opening the fastening units 94, 95 (as shown by arrows in FIG. 2) so as to make the contents drop out of the package, as shown in FIG. 2.

In view of above, since the conventional surface bonding fasteners have the above-mentioned drawbacks, it motivates the inventor of the present invention to research and develop an improved surface bonding fastener that is advantageous with respect to the conventional surface bonding fasteners as previously described.

SUMMARY OF INVENTION

One object of the present invention is to provide a surface bonding fastener for opening and closing an opening of a package, which can, while the package is reversely placed, prevent or efficiently reduce a possibility that the contents contained in the package make the opening of the package be opened unintentionally and then drop out of the package.

The present invention provides a surface bonding fastener for opening and closing an opening of a package, the surface bonding fastener comprising a first base sheet, a second base sheet, a first blocking sheet, a second blocking sheet, a plurality of first fastening units and a plurality of second fastening units. The first base sheet has a first surface, while the second base sheet has a second surface facing the first surface. The first blocking sheet is disposed on the first surface and has a first fixing end and a first free end, wherein the first fixing end is secured to the first surface, and the first free end is opposite to the first fixing end and is not connected to the first surface. The first fixing end is closer to the opening of the package than the first free end, and the first free end is between the first base sheet and the second base sheet. The second blocking sheet is disposed on the second surface and has a second fixing end and a second free end, wherein the second fixing end is secured to the second surface, and the second free end is opposite to the second fixing end and is not connected to the second surface. The second fixing end is closer to the opening of the package than the second free end, and the second free end is between the first base sheet and the second base sheet. The plurality of first fastening units and the plurality of second fastening units are disposed on the first free end and the second free end, respectively, and integrally molded with the first blocking sheet and the second blocking sheet, respectively. The plurality of first fastening units and the plurality of second fastening units are respectively arranged at intervals in a longitudinal direction and staggered in a transverse direction perpendicular to the longitudinal direction. The plurality of second fastening units are configured to be fastened with the plurality of first fastening units so as to close the opening of the package.

Preferably, the surface bonding fastener according to the present invention can be configured such that each of the first fastening units comprises a first hook and a second hook. The first hook has a first body extending from the first blocking sheet, and a first hook portion extending from the first body and bended toward a first direction. The second hook has a second body extending from the first blocking sheet, and a second hook portion extending from the second body and bended toward a second direction opposite to the first direction. The second body is adjacent to the first body in the transverse direction and integrally formed with the first body. The first body and the second body at least partly overlap with each other in the longitudinal direction, and an overlapping degree therebetween is configured to be determined based on a desired fastening strength between the plurality of first fastening units and the plurality of second fastening units. And, the surface bonding fastener according to the present invention can be further configured such that each of the second fastening units comprises a third hook and a fourth hook. The third hook has a third body extending from the second blocking sheet, and a third hook portion extending from the third body and bended toward the first direction. The fourth hook has a fourth body extending from the second blocking sheet, and a fourth hook portion extending from the fourth body and bended toward the second direction opposite to the first direction. The fourth body is adjacent to the third body in the transverse direction and integrally formed with the third body. The third body and the fourth body at least partly overlap with each other in the longitudinal direction, and an overlapping degree therebetween is configured to be determined based on a desired fastening strength between the plurality of first fastening units and the plurality of second fastening units. When the plurality of first fastening units and the plurality of second fastening units are fastened with each other, the first hook portions are configured to be engaged with the third hook portions, and the second hook portions are configured to be engaged with the fourth hook portions.

Preferably, a transverse spacing between the two adjacent first fastening units in the transverse direction is smaller than or equal to a transverse length of the first fastening unit in the transverse direction. And, a transverse spacing between the two adjacent second fastening units in the transverse direction is smaller than or equal to a transverse length of the second fastening unit in the transverse direction.

Preferably, a longitudinal spacing between the two adjacent first fastening units in the longitudinal direction is smaller than a longitudinal length of the first fastening unit in the longitudinal direction. And, a longitudinal spacing between the two adjacent second fastening units in the longitudinal direction is smaller than a longitudinal length of the second fastening unit in the longitudinal direction.

Further features and advantages of the present invention will become apparent after reviewing the following detailed descriptions and the accompanying drawings of the present invention.

DETAILED DESCRIPTION OF PREFERRED EMBODIMENT

Figure 1:
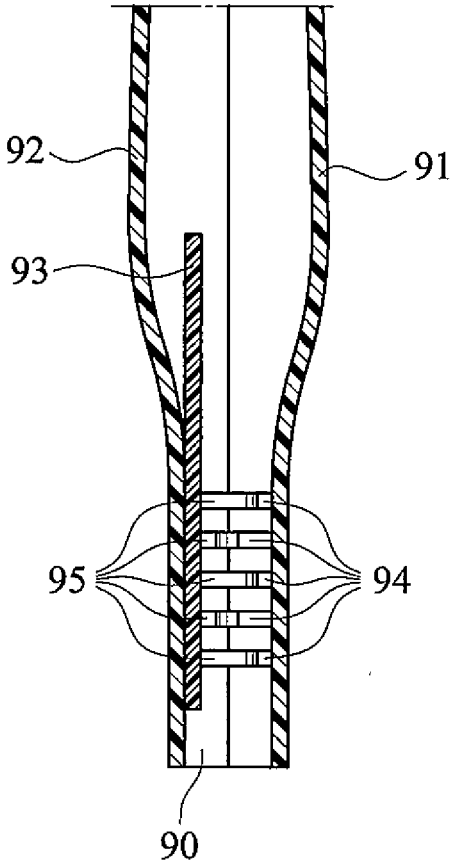
Fig. 1 (Prior Art)
FIG. 1 is a schematic cross-sectional view of a surface bonding fastener of the related prior art.
Figure 2:
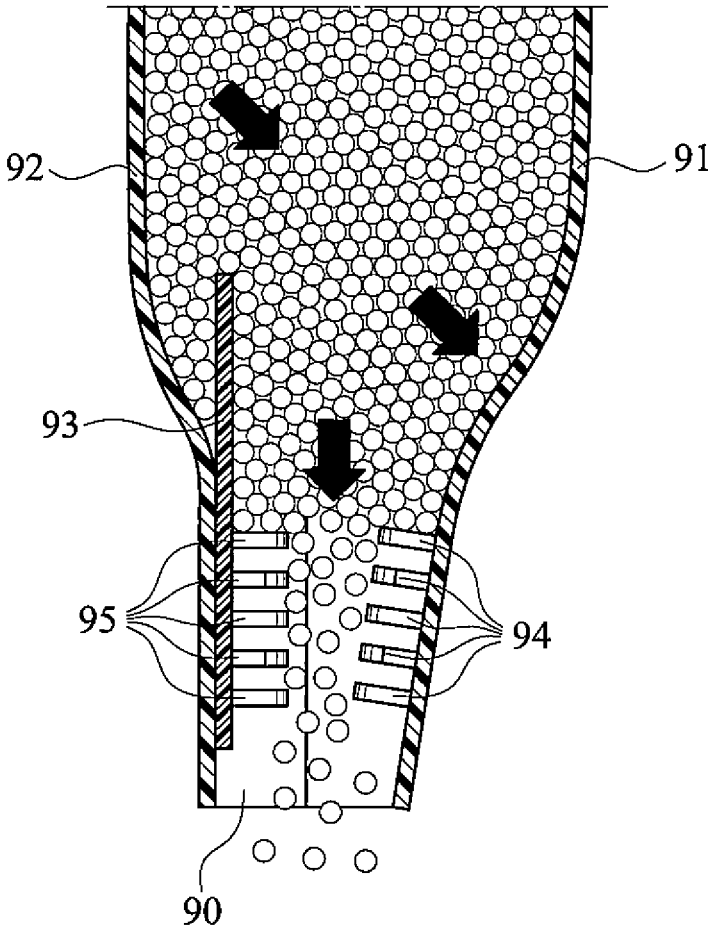
Fig. 2 (Prior Art)
FIG. 2 is a schematic cross-sectional view showing that the surface bonding fastener of the related prior art shown in FIG. 1 is opened by contents contained in a package.
Figure 3:
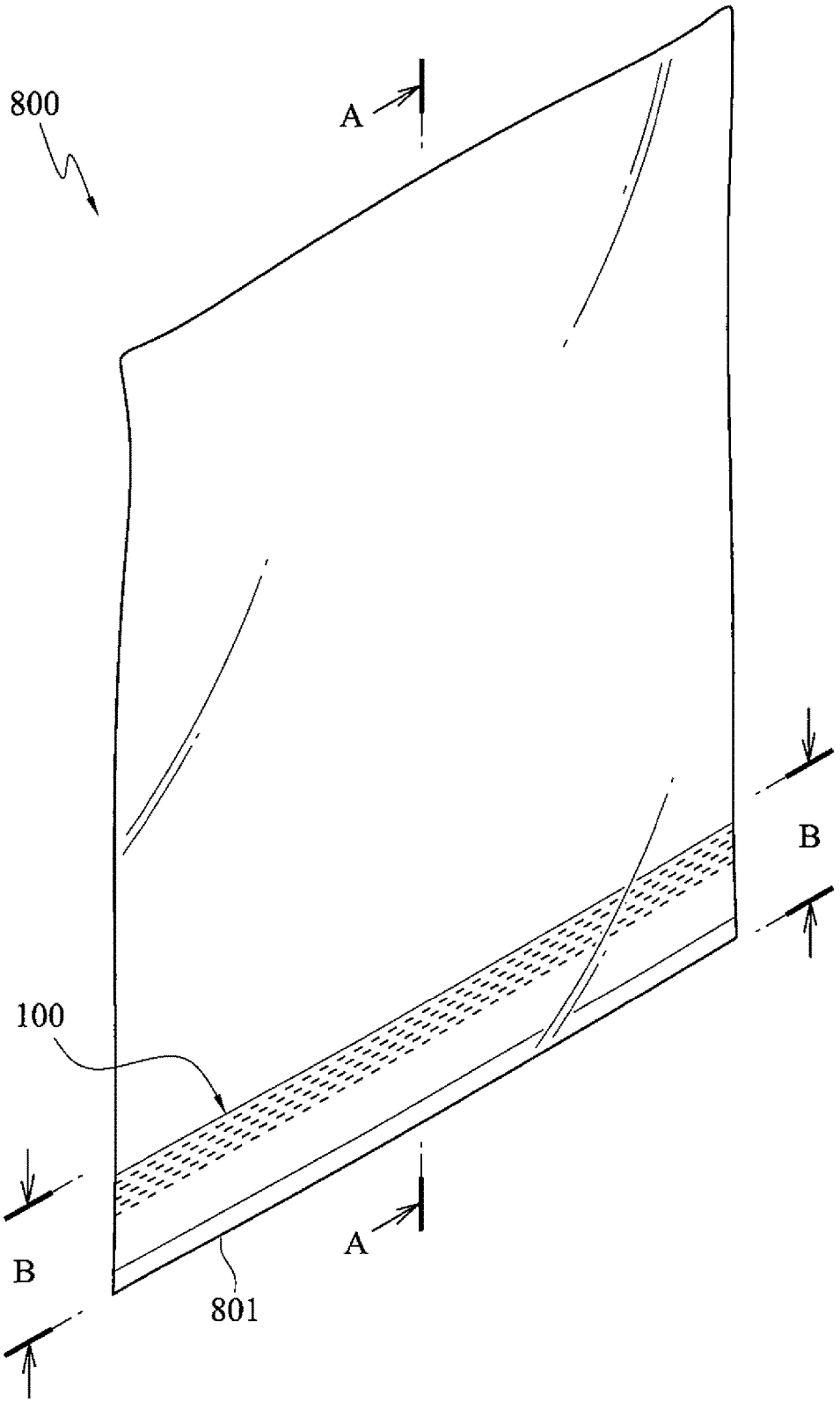
FIG. 3 is a schematic view of a zipper bag which utilizes a surface bonding fastener in accordance with the present invention.

FIG. 3 illustrates a zipper bag (package) 800 which utilizes a surface bonding fastener in accordance with the present invention. As shown in FIG. 3, the zipper bag 800 is provided with the surface bonding fastener 100 at a vicinity of an opening 801 thereof for opening and closing the opening 801 of the zipper bag 800.

Next, the surface bonding fastener 100 in accordance with the present invention will be described with reference to FIGS. 4 to 7.

Figure 4:
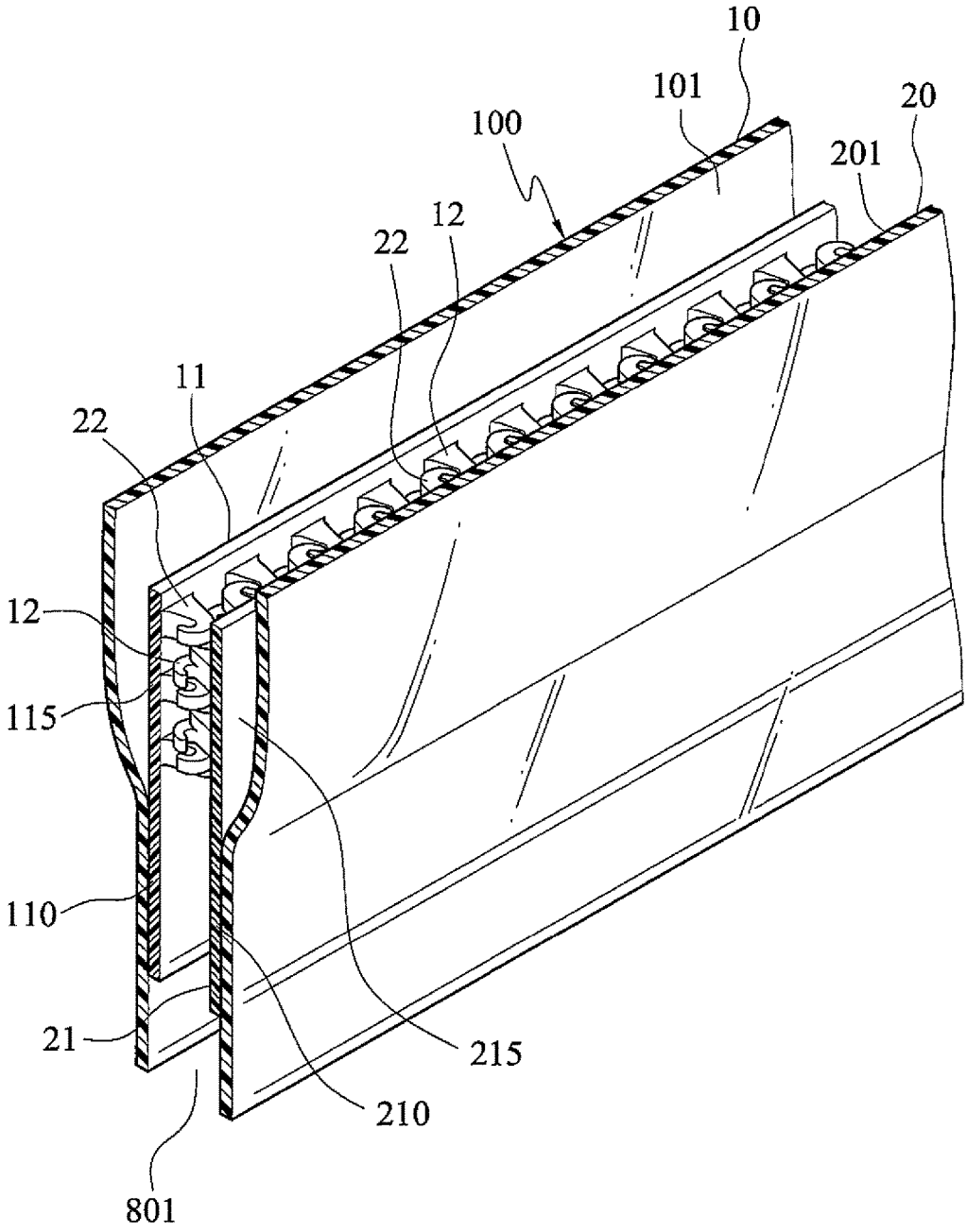
FIG. 4 is a schematic perspective view of a B-B portion of the zipper bag shown in FIG. 3 which utilizes the surface bonding fastener in accordance with the present invention and is taken along a line A-A.
Figure 5:
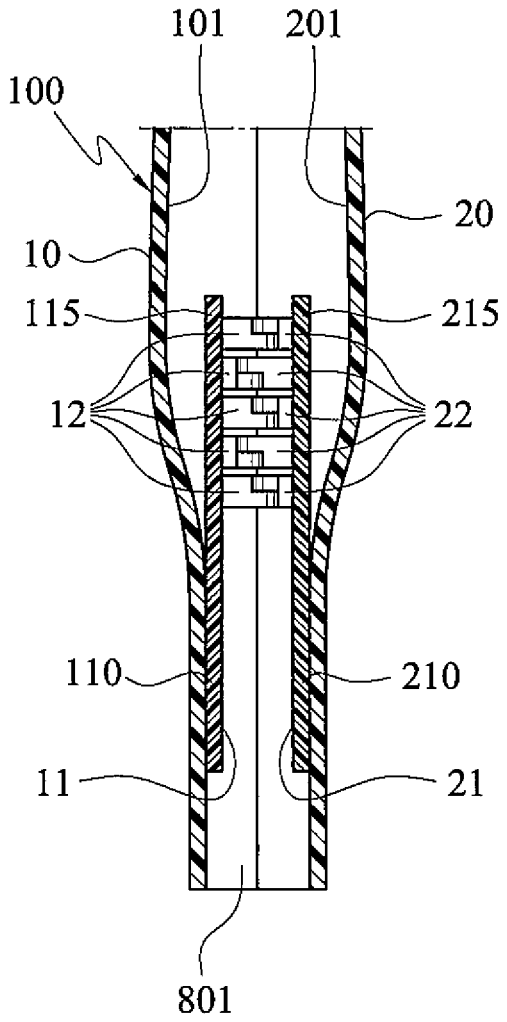
FIG. 5 is a schematic cross-sectional view of the B-B portion of the zipper bag shown in FIG. 3 which utilizes the surface bonding fastener in accordance with the present invention and is taken along the line A-A.

FIG. 4 is a schematic perspective view of a B-B portion of the zipper bag shown in FIG. 3 which utilizes the surface bonding fastener in accordance with the present invention and is taken along a line A-A, and FIG. 5 is a schematic cross-sectional view of the B-B portion of the zipper bag shown in FIG. 3 which utilizes the surface bonding fastener in accordance with the present invention and is taken along the line A-A. As shown in FIGS. 4 and 5, the surface bonding fastener 100 in accordance with the present invention includes a first base sheet 10, a second base sheet 20, a first blocking sheet 11, a second blocking sheet 21, a plurality of first fastening units 12 and a plurality of second fastening units 22.

The first base sheet 10 has a first surface 101, and the second base sheet 20 has a second surface 201. The first surface 101 of the first base sheet 10 and the second surface 201 of the second base sheet 20 face each other. In the present embodiment, the first base sheet 10 and the second base sheet 20 are two opposite sheets of the zipper bag 800 shown in FIG. 3, and the first surface 101 and the second surface 201 are inner surfaces of the zipper bag 800.

The first blocking sheet 11 is disposed on the first surface 101, and the second blocking sheet 21 is disposed on the second surface 201. The first blocking sheet 11 has a first fixing end 110 secured to the first surface 101, and a first free end 115 opposite to the first fixing end 110 and not connected to the first surface 101. The first fixing end 110 is closer to the opening 801 of the zipper bag 800 than the first free end 115. The second blocking sheet 21 has a second fixing end 210 secured to the second surface 201, and a second free end 215 opposite to the second fixing end 210 and not connected to the second surface 201. The second fixing end 210 is closer to the opening 801 of the zipper bag 800 than the second free end 215. Both of the first free end 115 and the second free end 215 are between the first base sheet 10 and the second base sheet 20.

The plurality of first fastening units 12 are disposed on the first free end 115 of the first blocking sheet 11 and integrally molded with the first blocking sheet 11. The plurality of second fastening units 22 are disposed on the second free end 215 of the second blocking sheet 21 and integrally molded with the second blocking sheet 21. The plurality of first fastening units 12 and the plurality of second fastening units 22 are configured to be fastened with each other so as to close the opening 801 of the zipper bag 800. The detailed descriptions of the plurality of first fastening units 12 and the plurality of second fastening units 22 will be described hereinafter.

Figure 6:
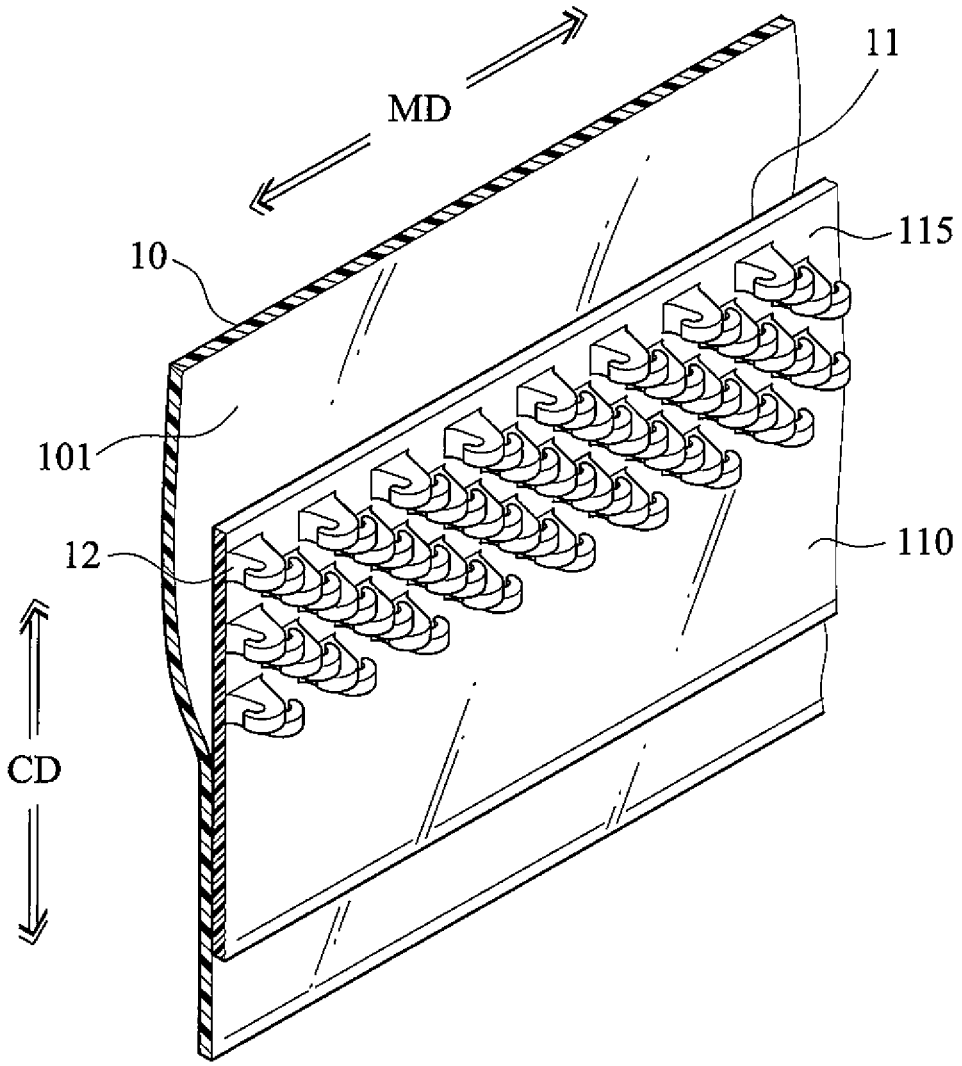
FIG. 6 is a schematic partial perspective view of FIG. 4 showing an arrangement of a plurality of first fastening units disposed on a first free end of a first blocking sheet.

FIG. 6 is a schematic partial perspective view of FIG. 4 showing an arrangement of the plurality of first fastening units 12 disposed on the first free end 115 of the first blocking sheet 11. Please note that, since configurations of the second base sheet, the second blocking sheet and the plurality of second fastening units in the surface bonding fastener of the present invention are substantially identical to that of the first base sheet, the first blocking sheet and the plurality of first fastening units, for the sake of clarity, FIG. 6 only shows the first base sheet 10, the first blocking sheet 11 disposed on the first surface 101 of the first base sheet 10, and the plurality of first fastening units 12 disposed on the first free end 115 of the first blocking sheet 11 and integrally molded with the first blocking sheet 11, while the second base sheet, the second blocking sheet and the plurality of second fastening units are omitted.

As clearly shown in FIG. 6, the plurality of first fastening units 12 disposed on the first free end 115 of the first blocking sheet 11 and integrally molded with the first blocking sheet 11 are configured to be arranged at intervals in a longitudinal direction MD and staggered in a transverse direction CD. Similarly, although not shown in FIG. 6, the plurality of second fastening units 22 disposed on the second free end 215 of the second blocking sheet 21 and integrally molded with the second blocking sheet 21 are also configured to be arranged at intervals in the longitudinal direction MD and staggered in the transverse direction CD.

Figure 7:
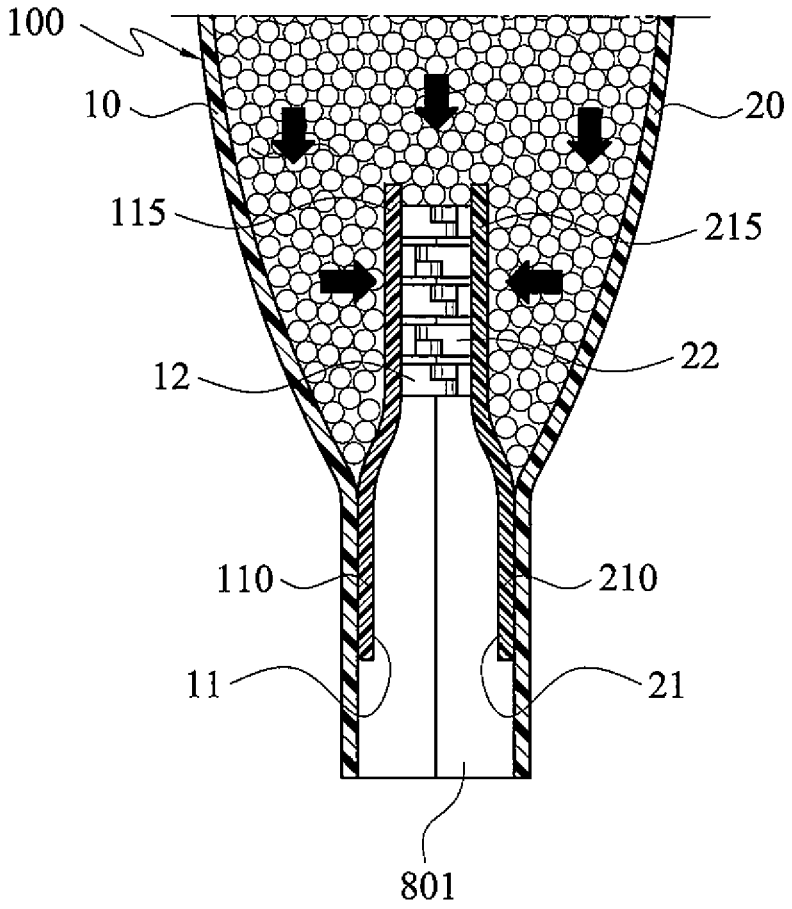
FIG. 7 is a schematic cross-sectional view of the surface bonding fastener, which is subjected to pressure from contents contained in the zipper bag, in accordance with the present invention.

FIG. 7 is a schematic cross-sectional view of the surface bonding fastener 100, which is subjected to pressure from contents contained in the zipper bag, in accordance with the present invention.

As shown in FIG. 7, when the zipper bag having the surface bonding fastener 100 of the present invention contains contents and is reversely placed, the contents contained in the zipper bag will move toward a direction of the opening 801, and apply pressure to the surface bonding fastener 100 which is used to close the opening 801 of the zipper bag due to weights thereof. However, since the surface bonding fastener 100 of the present invention is used to close the opening 801 by the mutual fastening between the first fastening units 12 disposed on the first free end 115 of the first blocking sheet 11 and the second fastening units 22 disposed on the second free end 215 of the second blocking sheet 21, when the zipper bag is reversely placed, the contents in the zipper bag will move into a space between the first free end 115 of the first blocking sheet 11 and the first base sheet 10 and into a space between the second free end 215 of the second blocking sheet 21 and the second base sheet 20, such that the first free end 115 and the second free end 215 will be pressed against each other (as shown by arrows in FIG. 7) and the first fastening units 12 on the first free end 115 and the second fastening units 22 on the second free end 215 will be fastened to each other more tightly. Thus, since the first fastening units 12 on the first free end 115 and the second fastening units 22 on the second free end 215 are fastened to each other more tightly by the pressure from the contents moved into the space between the first free end 115 and the first base sheet 10 and the space between the second free end 215 and the second base sheet 20, it is less likely to be opened due to the pressure applied by the contents in the zipper bag so as to prevent the opening 801 from being unintentionally opened easily.

Thus, when the zipper bag having the surface bonding fastener according to the present invention contains contents therein and is reversely placed, by the first fastening units on the first free end of the first blocking sheet and the second fastening units on the second free end of the second blocking sheet of the surface bonding fastener according to the present invention, the opening of this zipper bag is less likely to be opened due to the pressure from the contents contained therein thereby it is possible to prevent the contents from dropping out of the zipper bag.

Furthermore, since both the first fastening units and the second fastening units of the surface bonding fastener of the present invention are arranged at intervals with each other (that is, there are spacing existing between the two adjacent first fastening units and between the two adjacent second fastening units), the zipper bag having the surface bonding fastener of the present invention still has a function of discharging the remaining air therein. As a result, if the contents (e.g., cookies, feeds and the like) stored in the zipper bag are contents which is easily softened due to moisture, after fastening the first fastening units and the second fastening units with each other, the user can squeeze the zipper bag to discharge the air remaining in the zipper bag through spacing existing between the first fastening units and between the second fastening units, whereby it can prevent the contents from being affected with moisture, softening or deteriorating due to the air remaining in the zipper bag. And, although there are spacing between the first fastening units and between the second fastening units, such spacing are dispersive and narrow such that air existing outside of the zipper bag is less likely to flow back into the zipper bag. When compared with the completely sealed zipper bag in the prior art, although the user generally try to squeeze out the air in the zipper bag before closing its opening during using such zipper bag, yet in the actual operation, since the user needs to squeeze the zipper bag in a state that the opening of the zipper bag is opened by a minimal degree (only for discharging of the air and avoiding re-entering of the air as far as possible), such operation is quite difficult and usually cannot achieve the better discharging effect of air.

Next, the preferable example of the first fastening units 12 in the surface bonding fastener of the present invention will be further described with reference to FIGS. 8 and 9. Please note that, since the first fastening units 12 and the second fastening units 22 in the surface bonding fastener of the present invention have configurations which are substantially identical with each other, and are provided in the same manner with each other, in FIGS. 8 and 9, it merely illustrates and describes the first fastening units 12 in detail, while the second fastening units 22 is only described in a manner of words.

Figure 8:
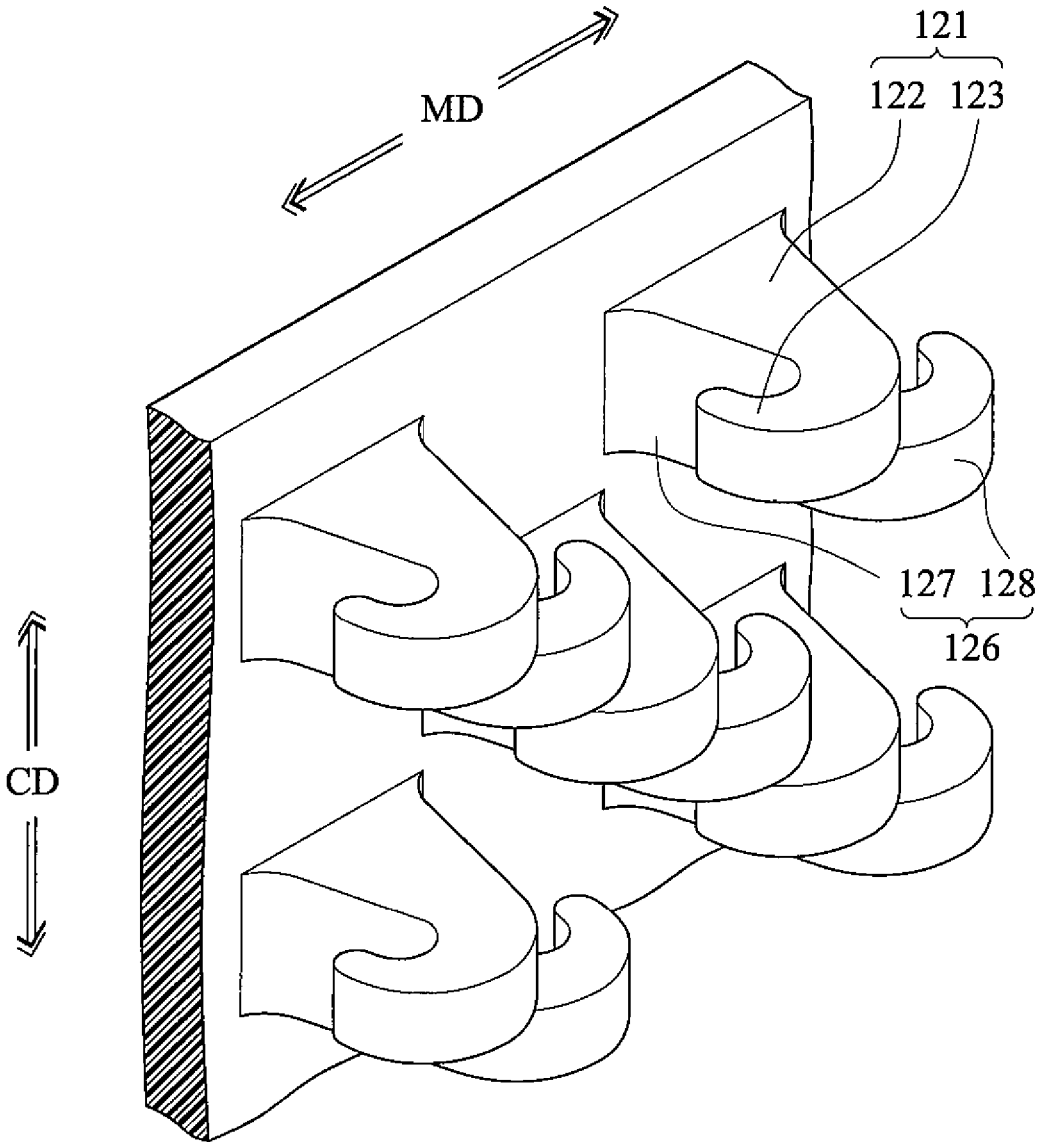
FIG. 8 is a schematic enlarged perspective view of the first fastening units of the surface bonding fastener in accordance with the present invention.

Preferably, each of the first fastening units 12 of the surface bonding fastener in accordance with the present invention includes a first hook 121 and a second hook 126, as shown in FIG. 8. The first hook 121 has a first body 122 extending from the first free end 115 of the first blocking sheet 11, and a first hook portion 123 extending from the first body 122 and bended toward a first direction. The second hook 126 has a second body 127 extending from the first free end 115 of the first blocking sheet 11, and a second hook portion 128 extending from the second body 127 and bended toward a second direction opposite to the first direction. The second body 127 is adjacent to the first body 122 in the transverse direction CD and integrally formed with the first body 122.

Similar to the first fastening unit 12 including the first hook 121 and the second hook 126 as previously described with reference to FIG. 8, each of the second fastening units of the surface bonding fastener of the present invention includes a third hook and a fourth hook. The third hook has a third body extending from the second free end of the second blocking sheet, and a third hook portion extending from the third body and bended toward the first direction. The fourth hook has a fourth body extending from the second free end of the second blocking sheet, and a fourth hook portion extending from the fourth body and bended toward the second direction opposite to the first direction. The fourth body is adjacent to the third body in the transverse direction and integrally formed with the third body.

When the first fastening units and the second fastening units of the surface bonding fastener in accordance with the present invention are fastened together, the first hook portions of the first fastening units and the third hook portions of the second fastening units are engaged with each other, and the second hook portions of the first fastening units and the fourth hook portions of the second fastening units are engaged with each other. As a result, the opening 801 of the zipper bag 800 (FIG. 3), which utilizes the surface bonding fastener in accordance with the present invention, can be closed by the plurality of first fastening units and the plurality of second fastening units which are fastened with each other.

Figure 9:
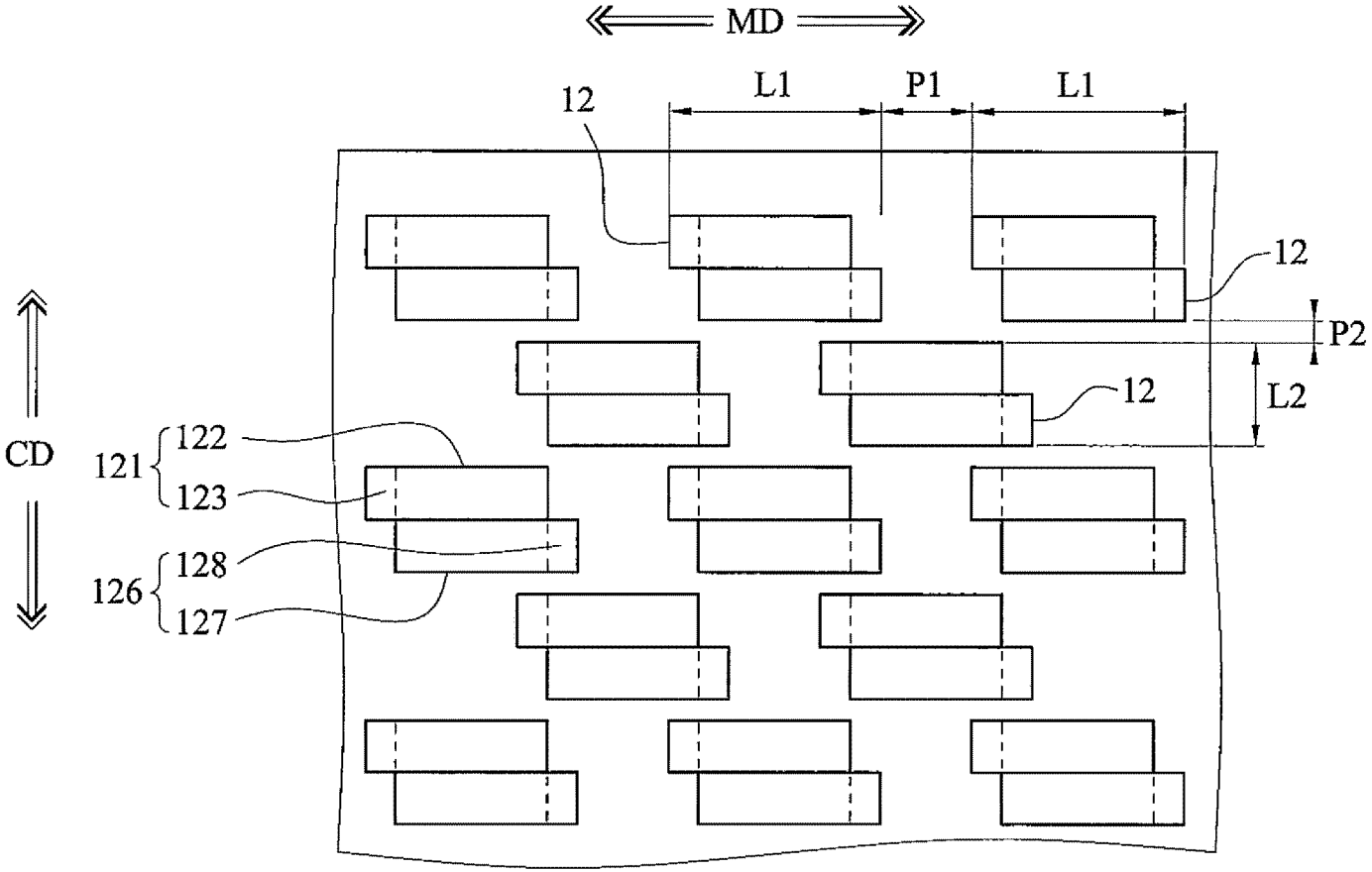
FIG. 9 is a schematic view of the arrangement of the first fastening units of the surface bonding fastener in accordance with the present invention.

On the other hand, as shown in FIG. 9, the first body 122 and the second body 127 of each of the first fastening units 12 are configured to at least partly overlap with each other in the longitudinal direction MD, and an overlapping degree is configured to be determined based on a desired fastening strength between the plurality of first fastening units 12 and the plurality of second fastening units 22. In FIG. 9, although the first body 122 and the second body 127 of each of the first fastening units 12 are shown as totally overlapping with each other in the longitudinal direction MD, yet the present invention is not limited thereto. For example, in view of the desired fastening strength between the plurality of first fastening units and the plurality of second fastening units, in the longitudinal direction, the first body and the second body also can be configured to only partly overlap with each other, that is, the first body and the second body are slightly offset with each other toward opposite directions along the longitudinal direction. In such case, if remaining the same spacing between the two adjacent fastening units in the longitudinal direction, in the range of the same area, amounts of the fastening units having the first body and the second body slightly offsetting with each other in the longitudinal direction will be less than amounts of the fastening units having the first body and the second body totally overlapping with each other in the longitudinal direction. As a result, the fastening strength that can be achieved by the fastening units having the first body and the second body slightly offsetting with each other in the longitudinal direction is weaker than the fastening strength that can be achieved by the fastening units having the first body and the second body totally overlapping with each other in the longitudinal direction.

Accordingly, the zipper bag having the surface bonding fastener of the present invention can determine an overlapping degree between the two bodies (the first body and the second body/the third body and the fourth body) of each of the fastening units (the first fastening unit and the second fastening unit) in the longitudinal direction based on a required fastening strength of the opening.

Moreover, referring back to FIG. 9, the surface bonding fastener in accordance with the present invention is configured such that a longitudinal spacing P1 between the two adjacent first fastening units 12 in the longitudinal direction MD is smaller than a longitudinal length L1 of the first fastening unit 12 in the longitudinal direction MD. And, a transverse spacing P2 between the two adjacent first fastening units 12 in the transverse direction CD is smaller than a transverse length L2 of the first fastening unit 12 in the transverse direction CD. Furthermore, in FIG. 9, although the transverse spacing P2 between the two adjacent first fastening units 12 in the transverse direction CD is smaller than the transverse length L2 of the first fastening unit 12 in the transverse direction CD, yet in fact, based on a desired fastening strength of the surface bonding fastener, the transverse spacing P2 between the two adjacent first fastening units 12 in the transverse direction CD can also be set as being equal to the transverse length L2 of the fastening unit 12 in the transverse direction CD.

Although in the abovementioned descriptions, the surface bonding fasteners of the present invention are described with being utilized to the zipper bag shown in FIG. 3 as examples, yet it should be understood that, the surface bonding fasteners of the present invention can also be utilized to the package other than the zipper bag.

Although the several aspects of the present invention have been described in the abovementioned embodiments with reference to the accompanying drawings, such embodiments merely are the preferred embodiments of the present invention and are not intended to limit the scopes of the present invention into the specific features and structures as illustrated in the abovementioned descriptions and the accompanying drawings. A person skilled in the art of the present invention can envisage various changes and modifications within the spirit of the present invention, and such changes and modifications are also included in the scopes of the present invention.

The invention claimed is:

1. A surface bonding fastener for opening and closing an opening of a package, comprising:

a first base sheet having a first surface;

a second base sheet having a second surface facing the first surface;

a first blocking sheet disposed on the first surface, the first blocking sheet having a first fixing end secured to the first surface and a first free end opposite to the first fixing end and not connected to the first surface, wherein the first fixing end is closer to the opening of the package than the first free end, and the first free end is between the first base sheet and the second base sheet;

a second blocking sheet disposed on the second surface, the second blocking sheet having a second fixing end secured to the second surface and a second free end opposite to the second fixing end and not connected to the second surface, wherein the second fixing end is closer to the opening of the package than the second free end, and the second free end is between the first base sheet and the second base sheet;

a plurality of first fastening units disposed on the first free end and integrally molded with the first blocking sheet, the plurality of first fastening units arranged at intervals in a longitudinal direction and staggered in a transverse direction perpendicular to the longitudinal direction, each of the first fastening units comprising a first hook and a second hook, the first hook having a first body extending from the first blocking sheet and a first hook portion extending from the first body and bended toward a first direction, the second hook having a second body extending from the first blocking sheet and a second hook portion extending from the second body and bended toward a second direction opposite to the first direction, wherein the second body is adjacent to the first body in the transverse direction and integrally formed with the first body, and the first body and the second body only partly overlap with each other in the longitudinal direction, and an overlapping degree between the first body and the second body in the longitudinal direction is configured to be determined based on a desired fastening strength between the first fastening units and the second fastening units; and a plurality of second fastening units disposed on the second free end and integrally molded with the second blocking sheet, the plurality of second fastening units arranged at intervals in the longitudinal direction and staggered in the transverse direction, wherein the second fastening units are configured to be fastened with the first fastening units so as to close the opening of the package, each of the second fastening units comprising a third hook and a fourth hook, the third hook having a third body extending from the second blocking sheet and a third hook portion extending from the third body and bended toward the first direction, the fourth hook having a fourth body extending from the second blocking sheet and a fourth hook portion extending from the fourth body and bended toward the second direction, wherein the fourth body is adjacent to the third body in the transverse direction and integrally formed with the third body, and the third body and the fourth body only partly overlap with each other in the longitudinal direction, and an overlapping degree between the third body and the fourth body in the longitudinal direction is configured to be determined based on a desired fastening strength between the first fastening units and the second fastening units, wherein when the first fastening units and the second fastening units are fastened with each other, the first hook portions are configured to be engaged with the third hook portions, and the second hook portions are configured to be engaged with the fourth hook portions.

2. The surface bonding fastener of claim 1, wherein a transverse spacing between the two adjacent first fastening units in the transverse direction is smaller than or equal to a transverse length of the first fastening unit in the transverse direction, and a transverse spacing between the two adjacent second fastening units in the transverse direction is smaller than or equal to a transverse length of the second fastening unit in the transverse direction.

3. The surface bonding fastener of claim 1, wherein a longitudinal spacing between the two adjacent first fastening units in the longitudinal direction is smaller than a longitudinal length of the first fastening unit in the longitudinal direction, and a longitudinal spacing between the two adjacent second fastening units in the longitudinal direction is smaller than a longitudinal length of the second fastening unit in the longitudinal direction.

* * * * *